US008276659B2

(12) United States Patent
Fordyce et al.

(10) Patent No.: US 8,276,659 B2
(45) **Date of Patent: *Oct. 2, 2012**

(54) PROPPANT ADDITION SYSTEM AND METHOD

(75) Inventors: Victor Fordyce, Red Deer (CA); Dwight Loree, Black Creek (CA)

(73) Assignee: GASFRAC Energy Services Inc., Calgary (CA)

( * ) Notice: Subject to any disclaimer, the term of this patent is extended or adjusted under 35 U.S.C. 154(b) by 671 days.

This patent is subject to a terminal disclaimer.

(21) Appl. No.: 12/345,531

(22) Filed: Dec. 29, 2008

(65) Prior Publication Data

US 2009/0183874 A1 Jul. 23, 2009

Related U.S. Application Data

(63) Continuation-in-part of application No. 11/681,737, filed on Mar. 2, 2007.

(30) Foreign Application Priority Data

Mar. 3, 2006 (CA) ..... 2538936
Dec. 24, 2008 (CA) ..... 2649203

(51) Int. Cl.
*E21B 43/26* (2006.01)

(52) U.S. Cl. ..... 166/75.15; 166/90.1; 166/308.1

(58) Field of Classification Search ..... None
See application file for complete search history.

(56) References Cited

U.S. PATENT DOCUMENTS 2,888,988 A 6/1959 Clark
3,108,636 A 10/1963 Peterson
3,137,344 A 6/1964 Wiemer
(Continued)

FOREIGN PATENT DOCUMENTS

CA 1 043 091 11/1978
(Continued)

OTHER PUBLICATIONS

"Chemical Safety Data: Hexane," Oxford Hands-On Science [online], <http://cartwright.chem.ox.ac.uk/hsci/chemicals/hexane.html>, Oxford, U.K., Oct. 11, 2004, 2 pages.

(Continued)

*Primary Examiner* — Angela M DiTrani
(74) *Attorney, Agent, or Firm* — Christensen O'Connor Johnson Kindness PLLC

(57) ABSTRACT

An apparatus and related method for fracturing a formation penetrated by a well comprises a frac pressure pump, a frac fluid source, and a proppant supply source. The frac pressure pump is connected to the well. The frac fluid source is connected to supply a stream of frac fluid to the frac pressure pump. The proppant supply source has a proppant receiver, a positive displacement pump, and at least an inlet into the proppant supply source. The at least an inlet is connected to one or more liquid hydrocarbon sources to supply liquid hydrocarbons to proppant in the proppant supply source. The positive displacement pump is connected to pump proppant into the stream of frac fluid before the frac pressure pump. Fluid lines connecting the frac pressure pump, the well, and the frac fluid source have isolation valves spaced so that the volume of fluid containable between any set of neighboring isolation valves is less than or equal to 500 L.

18 Claims, 3 Drawing Sheets

U.S. PATENT DOCUMENTS

| | | | | |
|---|---|---|---|---|
| 3,378,074 | A * | 4/1968 | Kiel | 166/308.4 |
| 3,560,053 | A | 2/1971 | Ortloff | |
| 3,775,069 | A | 11/1973 | Whitney | |
| 3,842,910 | A | 10/1974 | Zingg | |
| 3,846,310 | A | 11/1974 | Blackwell | |
| 4,374,545 | A | 2/1983 | Bullen | |
| 4,665,982 | A | 5/1987 | Brown | |
| 4,701,270 | A | 10/1987 | Bullen | |
| 4,915,505 | A | 4/1990 | Arribau | |
| 5,069,283 | A | 12/1991 | Mack | |
| 5,472,049 | A | 12/1995 | Chaffee | |
| 5,515,920 | A | 5/1996 | Luk | |
| 5,883,053 | A | 3/1999 | Tudor | |
| 5,899,272 | A | 5/1999 | Loree | |
| 6,007,227 | A * | 12/1999 | Carlson | 700/67 |
| 6,216,786 | B1 | 4/2001 | Griffin | |
| 7,168,490 | B2 | 1/2007 | Taylor | |
| 7,314,850 | B2 | 1/2008 | Taylor | |
| 7,341,103 | B2 | 3/2008 | Taylor | |
| 2005/0006089 | A1 | 1/2005 | Justus | |
| 2005/0016732 | A1 | 1/2005 | Brannon | |
| 2005/0211438 | A1 | 9/2005 | Stromquist | |
| 2006/0065400 | A1 | 3/2006 | Smith | |
| 2006/0231254 | A1 | 10/2006 | Peskunowicz | |
| 2007/0000666 | A1 | 1/2007 | Vozniak | |
| 2007/0125543 | A1 | 6/2007 | McNeel | |
| 2007/0125544 | A1 | 6/2007 | Robinson | |
| 2007/0201305 | A1 | 8/2007 | Heilman | |
| 2007/0204991 | A1 | 9/2007 | Loree | |
| 2009/0301719 | A1 | 12/2009 | Bull | |

FOREIGN PATENT DOCUMENTS

| | | | |
|---|---|---|---|
| CA | 2 217 891 | | 11/1997 |
| CA | 2 441 640 | A1 | 3/2005 |
| CA | 2 557 459 | A1 | 9/2005 |
| CA | 2 644 169 | A1 | 9/2005 |
| EP | 0 695 852 | A2 | 2/1996 |
| GB | 1 439 735 | | 6/1976 |
| GB | 2 186 682 | A | 8/1987 |
| WO | 2006/116255 | A1 | 11/2006 |
| WO | 2007/096660 | A1 | 8/2007 |
| WO | 2007/113528 | A1 | 10/2007 |
| WO | 2007/141715 | A1 | 12/2007 |
| WO | 2009/147394 | A1 | 12/2009 |

OTHER PUBLICATIONS

"Chemical Safety Data: Pentane," Oxford Hands-On Science [online], <http://cartwright.chem.ox.ac.uk/hsci/chemicals/pentane.html>, Oxford, U.K., Feb. 9, 2004, 2 pages.

Condor Engineering & Manufacturing, LLC, Oil Well Services Equipment, Home Page, <http://condorengr.com/> [retrieved Dec. 3, 2008], 1 page.

Coulter, A.W., Jr., et al., "Remedial Cleanup, Sand Control, and Other Stimulation Treatments," in H.B. Bradley (ed.), "Petroleum Engineering Handbook," 2nd Printing, Society of Petroleum Engineers, Richardson, Texas, 1989, Chap. 56, pp. 56-1-56-9.

Extended European Search Report mailed Mar. 1, 2011, issued in corresponding European Application No. 07 71 0678.9, filed Mar. 2, 2007, 8 pages.

"Hydraulic Fracturing Technology: Technology Evaluation Report," EPA/540/R-93/505, U.S. Environmental Protection Agency, Risk Reduction Engineering Laboratory, Cincinnati, Ohio, Sep. 1993, 147 pages.

Martinez, S.J., et al., "Formation Fracturing," in H.B. Bradley (ed.), Petroleum Engineering Handbook, 2nd Printing, Society of Petroleum Engineers, Richardson, Texas, Jun. 1989, Chap. 55, pp. 55-1-55-12.

"Pumping of Flammable Fluids: Industry Recommended Practice (IRP), vol. 8—2002," Enform, Drilling and Completion Committee, Calgary, Alberta, Canada, 2002, 81 pages.

* cited by examiner

PROPPANT ADDITION SYSTEM AND METHOD

TECHNICAL FIELD

This document relates to proppant addition systems and methods, and particularly to low or atmospheric pressure proppant addition systems and methods.

BACKGROUND

In the conventional fracturing of wells, producing formations, new wells or low producing wells that have been taken out of production, a formation can be fractured to attempt to achieve higher production rates. Proppant and frac fluid are mixed in a blender and then pumped into a well that penetrates an oil or gas bearing formation. High pressure is applied to the well, the formation fractures and proppant carried by the fracturing fluid flows into the fractures. The proppant in the fractures holds the fractures open after pressure is relaxed and production is resumed. Various fluids have been disclosed for use as the fracturing fluid, including various mixtures of hydrocarbons, liquefied petroleum gas, nitrogen, and carbon dioxide.

Proppant addition can be added into a pressurized stream of frac fluid, for example liquefied petroleum gas, directly by having the proppant addition tank itself contained under pressure. Proppant addition systems into LPG, such as those disclosed in WO/2007/098606, often use centrifugal pumps to dynamically seal the proppant from the volatile stream of frac fluid. However, a pressure vessel is still required, as the dynamic seal is only present whilst the centrifugal pump is in operation. Systems have been proposed to avoid the use of a pressure contained proppant tank, for example by sending a stream of proppant blended with frac oils, and a stream of liquefied petroleum gas as (LPG) to separate frac pressure pumps, after which the two streams are combined at pressure and then used to frac a well. This system requires the use and coordination of multiple sets of frac pressure pumps, which are expensive and costly to operate. The outlet pressures from the two sets of frac pressure pumps must be balanced correctly, which makes the pumping difficult to control. It also requires that the mixture of proppant be mixed with substantial amounts of low vapor pressure frac oils, which may seriously reduce the positive effects of the LPG frac fluid, namely easy clean up and recovery from the well.

SUMMARY

An apparatus for fracturing a formation penetrated by a well is disclosed comprising a frac pressure pump, a frac fluid source, and a proppant supply source. The frac pressure pump is connected to the well. The frac fluid source is connected to supply a stream of frac fluid to the frac pressure pump. The proppant supply source has a proppant receiver, a positive displacement pump, and at least an inlet into the proppant supply source. The at least an inlet is connected to one or more liquid hydrocarbon sources to supply liquid hydrocarbons to proppant in the proppant supply source. The positive displacement pump is connected to pump proppant into the stream of frac fluid before the frac pressure pump.

A method is also disclosed. Proppant and liquid hydrocarbons are supplied into a proppant supply source to create a mixture of proppant and liquid hydrocarbons. The mixture of proppant and liquid hydrocarbons is pumped from the proppant supply source into a stream of frac fluid using a positive displacement pump. The stream of frac fluid containing the mixture of proppant and liquid hydrocarbons is then pumped to a frac pressure pump connected to a well.

An apparatus for fracturing a formation penetrated by a well is also disclosed, the apparatus comprising a frac pressure pump, a frac fluid source, and fluid lines. The frac pressure pump is connected to the well. The frac fluid source is connected to supply a stream of frac fluid to the frac pressure pump. The fluid lines connect the frac pressure pump, the well, and the frac fluid source, the fluid lines having isolation valves spaced so that the volume of fluid containable between any set of neighboring isolation valves is less than or equal to 500 L.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Proppant may be required to be supplied into a stream of fluid, for example a stream of frac fluid. In some cases it is desirable to supply the proppant as a mixture of proppant and liquid. This wets the proppant, allowing it to be more easily transferred from the proppant supply source and into the stream of frac fluid. In cases where the proppant is being supplied into a high pressure stream of fluid such as liquefied petroleum gas, the proppant supply source may need to be under positive pressure. The liquid in the mixture of proppant and liquid can then act as a liquid seal to prevent gas breakthrough from the proppant supply source into the frac fluid. In some cases the proppant supply source must be under positive pressure when the liquid itself in the proppant has a high vapor pressure, such as when liquefied petroleum gas is added to the proppant. LPG will vaporize at atmospheric pressure creating a hazardous situation.

Figure 1:
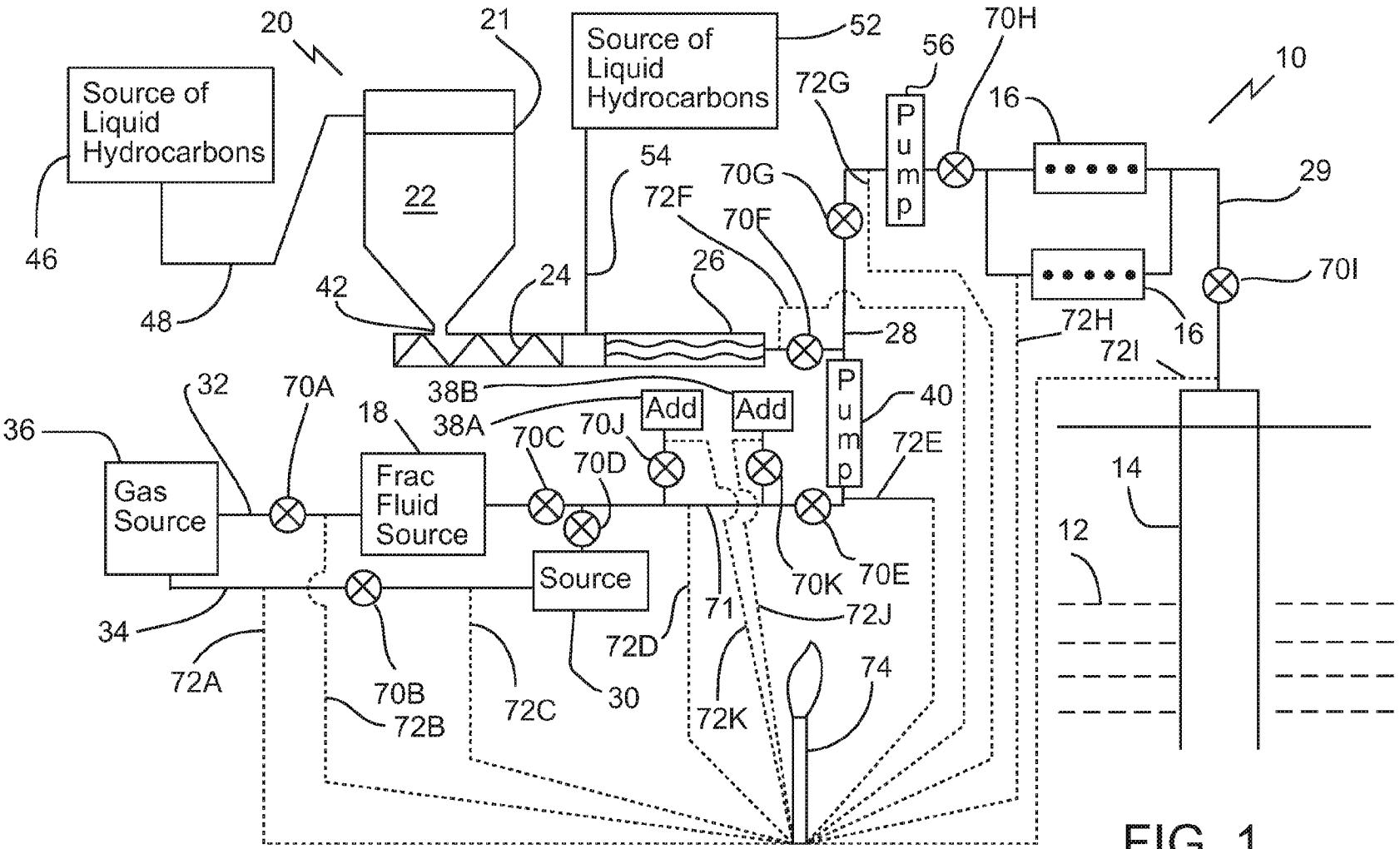
FIG. 1 is a schematic illustrating an apparatus for fracturing a formation penetrated by a well.

Referring to FIG. 1, an apparatus 10 for fracturing a formation 12 penetrated by a well 14 is illustrated. Apparatus 10 comprises a frac pressure pump 16, a frac fluid source 18, and a proppant supply source 20. Frac pressure pump 16 is connected to the well 14.

A frac fluid source 18 is connected to supply a stream of frac fluid to the frac pressure pump 16, through line 28 for example. In some embodiments the stream of frac fluid is volatile, for example if frac fluid source 18 comprises LPG. For cost effectiveness, the LPG may be predominantly propane or butane or a propane and butane mix. The frac fluid may also contain minor amounts of pentane and higher hydrocarbons. In some embodiments, the frac fluid comprises liquefied gas, such as LPG or $CO_2$. Referring to FIG. 1, liquefied $CO_2$ may be supplied to the stream of frac fluid via source 30. In some embodiments, source 30 may supply other frac fluids, such as lower vapor pressure hydrocarbons. Gas, such as inert gas, may be supplied to each of tanks 18, 30, via lines 32, 34 from gas source 36 as needed. Inert gas may be required to maintain liquefying or drive pressure on the LPG contained in tank 18. Various additives can be introduced into the stream of frac fluid, such as gelling agents, breakers, and activators for example, via additive sources 38A-38B. Additives may be added to the stream before or after the introduction of proppant. A pump 40 may be provided in order to provide the pumping pressure required to move the stream of frac fluid through line 28.

Figure 2:
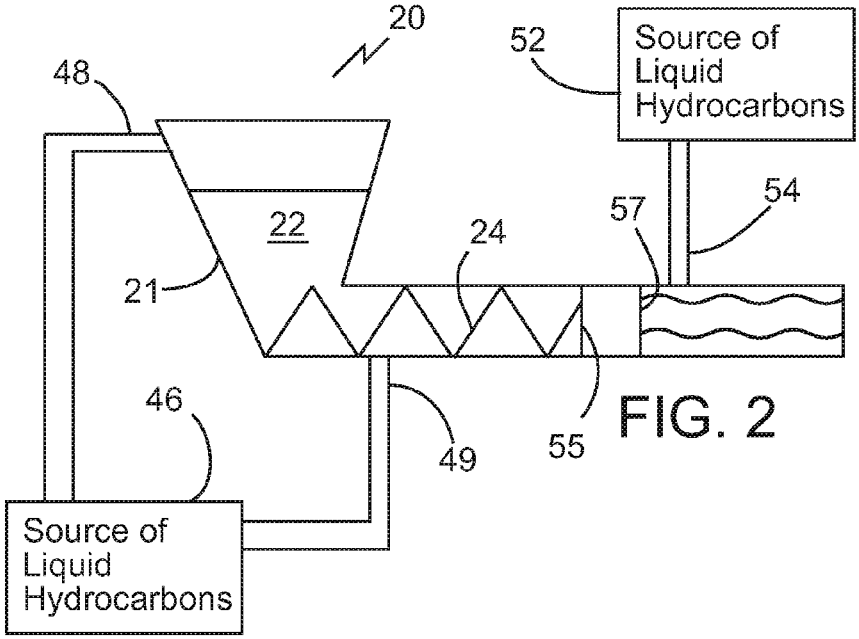
FIG. 2 is a side elevation view, in section, of an embodiment of a proppant supply source that may be used in the system of FIG. 1.

Proppant supply source 20 is illustrated as having a proppant receiver 21, a positive displacement pump 26, and at least an inlet into the proppant supply source 20 (shown for example as inlet 48). The at least an inlet is connected to one or more liquid hydrocarbon sources, for example source 46, to supply liquid hydrocarbons to proppant in the proppant supply source 20. Proppant supply source 20 is illustrated as containing a mixture of proppant and liquid hydrocarbons (shown as mixture 22). The liquid hydrocarbons may comprise hydrocarbons having six or more carbons. In some embodiments, the proppant receiver 21 has an auger 24 for supplying at least proppant, and preferably a mixture of proppant and liquid hydrocarbons, to pump 26. Referring to FIG. 1, the proppant receiver 21 may comprise an outlet 42 for supplying the mixture of proppant and liquid hydrocarbons to the auger 24. Referring to FIG. 2, in other embodiments the auger 24 is located at least partially inside the proppant receiver 21, for example along the base of receiver 21. This way, proppant may be easily channeled from receiver 21 to pump 26. The proppant supply source 20 may be at or below atmospheric pressure, for example if proppant supply source 20 is open to the atmosphere. In FIG. 2, the proppant receiver 21 may be an open topped 100 tonne hopper, which makes for easy addition of proppant into proppant receiver 21.

Referring to FIG. 1, the positive displacement pump 26 is connected to pump proppant, for example a mixture of proppant and liquid hydrocarbons, into the stream of frac fluid before the frac pressure pump(s) 16. In some embodiments, pump 26 is connected to pump the mixture of proppant and liquid hydrocarbons from the auger 24 into the stream of frac fluid. Positive displacement pumps cause a fluid to move by trapping a fixed amount of it and then displacing the trapped volume into a discharge zone, for example line 28. Positive displacement pumps are advantageous because they provide a pressure seal between the inlet and the outlet. Thus, a mixture of wetted proppant may be added at atmospheric pressure to a pressurized stream of frac fluid. This is advantageous over the use of a centrifugal pump in that, should the pump fail, the pressure seal is maintained. Thus, there is no requirement that the proppant supply source 20 be contained under pressure. Further, positive displacement pumps are advantageous because they are capable of providing relatively stable flow rates regardless of varying pressures in the outlet stream. Thus, a positive displacement pump allows a user more control over the amount of proppant added to the frac stream, and hence more control over the frac itself.

Pump 26 may be a progressive cavity pump. Progressive cavity pumps are used downhole as sand pumps, and are advantageous because they are capable of moving fluid containing large quantities of solids. A progressive cavity pump is also known as a progressing cavity pump, eccentric screw pump or even just a cavity pump. Names can vary from industry to industry and even regionally, including, MOYNO™ pump, Mohno pump, Nemo pump, and SEEPEX™ pump. This type of pump transfers fluid by means of the progress, through the pump, of a sequence of cavities as its rotor is turned in relation to a stator. This leads to the volumetric flow rate being proportional to the rotation rate and to low levels of shearing being applied to the pumped fluid. Hence these pumps have application in fluid metering and pumping of viscous or shear sensitive materials. In some embodiments, positive displacement pump 26 may be another type of pump, for example a screw pump or lobe pump.

Referring to FIG. 2, apparatus 10 (shown in detail in FIG. 1) may further comprise a pressure seal between the proppant receiver 21 and the positive displacement pump 26. Referring to FIG. 2, in some embodiments the pressure seal (illustrated as pressure seal 57) may simply be created by the positive displacement pump. In other embodiments, a pressure seal 55 may be in place for example after auger 24, pressure seal 55 allowing fluids to pass into pump 26.

Referring to FIG. 1, a first inlet 48 of the at least an inlet may be connected into the proppant supply source 20 before the pressure seal. The first inlet may be at least one inlet. Referring to FIGS. 1 and 2, liquid hydrocarbons can be supplied to proppant in proppant supply source 20 from a variety of locations. Referring to FIG. 1, liquid hydrocarbons are supplied into proppant receiver 21. Referring to FIG. 2, liquid hydrocarbons may be supplied through first inlets 48 and 49 into the proppant receiver 21 and auger 24, respectively. The first inlet has its liquid hydrocarbons supplied by a liquid hydrocarbon source 46 of the one or more liquid hydrocarbon sources. In some embodiments, each of first inlets 48 and 49 may have different liquid sources. The liquid hydrocarbon source 46 connected to supply the first inlet may comprise hydrocarbons having six or more carbons. Suitable liquid hydrocarbons added to the proppant supply source 20 from the one or more liquid hydrocarbon sources may include hydrocarbons having between eight and ten carbons, or for example eleven to fourteen carbons. It may be advantageous to use hydrocarbons with the least number of carbons possible that are non-volatile, for example when the frac fluid comprises LPG. Non-volatile hydrocarbons have at least one of a low vapor pressure and a high boiling point. The liquid hydrocarbons may have a vapor pressure of less than 200 mm Hg at room temperature, for example a vapor pressure of less than 15 mm Hg at room temperature. Because higher weight hydrocarbons, for example C6-C20 are harder to remove from the formation in contrast to LPG, an amount of liquid hydrocarbons sufficient to only wet the proppant may be added to minimize the liquid hydrocarbons supplied into the stream of frac fluid. Wetted may refer to only enough liquid hydrocarbon to saturate the pores of the proppant contained within vessel 20. Because sand has around 30% porosity an exemplary load of 15 tonnes (15000 kg) of sand would contain 3 $m^3$ of propane, or 200 L per tonne of sand. However, the low vapor pressure means that the liquid hydrocarbon and proppant mixture does not have to be contained within a pressure vessel, particularly when the hydrocarbons have seven or more carbons. For hydrocarbons having five or six carbons, addition of the hydrocarbons under sealed conditions is desirable.

Referring to FIG. 2, apparatus 10 may further comprise a second inlet 54 of the at least an inlet connected to supply liquid hydrocarbons into the proppant supply source 20 after the pressure seal, for example seals after at least one of 55 and 57. Liquid may be supplied through inlet 54 from liquid hydrocarbon source 52 of the one or more liquid hydrocarbon sources. Suitable liquids include hydrocarbons having six or more carbons, and other frac oils. Other liquids may be present as desired, for example alcohols. In some embodiments, the liquid hydrocarbon source 52 connected to supply the second inlet 54 comprises liquefied petroleum gas, including, for example, propane, butane or pentane or mixtures thereof. This way, the proppant may be wetted with liquefied petroleum gas prior to being supplied into the stream of frac fluid. In other embodiments, other high vapor pressure liquids may be added via second inlet 54. It should be understood that at least one of inlets 48, 49, and 54 may be present. The inlet 54 is illustrated as being connected directly into pump 26, although this is not required.

Referring to FIG. 1, the pressure applied by the frac pressure pump 16 may be a pressure suitable for fracturing the formation 12. An example frac pressure pump is a diesel quintuplex pump with water cooled turbines, or an electrically powered triplex piston pump, but any suitable pump may be used. As illustrated, more than one pumping device may be used as the pump 16.

Referring to FIG. 1, the stream of frac fluid may have a boost pump 56 for pumping the stream of frac fluid in high ambient temperatures, for example those seen in Texas in the daytime in summer. Boost pump 56 may be positioned at any point along line 28 and provides extra pressure, for example 300 psi, in order to retain the LPG or other liquefied gas in the liquid state in the stream of frac fluid. The stream of frac fluid may then pass into a blender (not shown) where other chemicals may be added to the stream of frac fluid, and then on to the frac pressure pumps.

Figure 3:
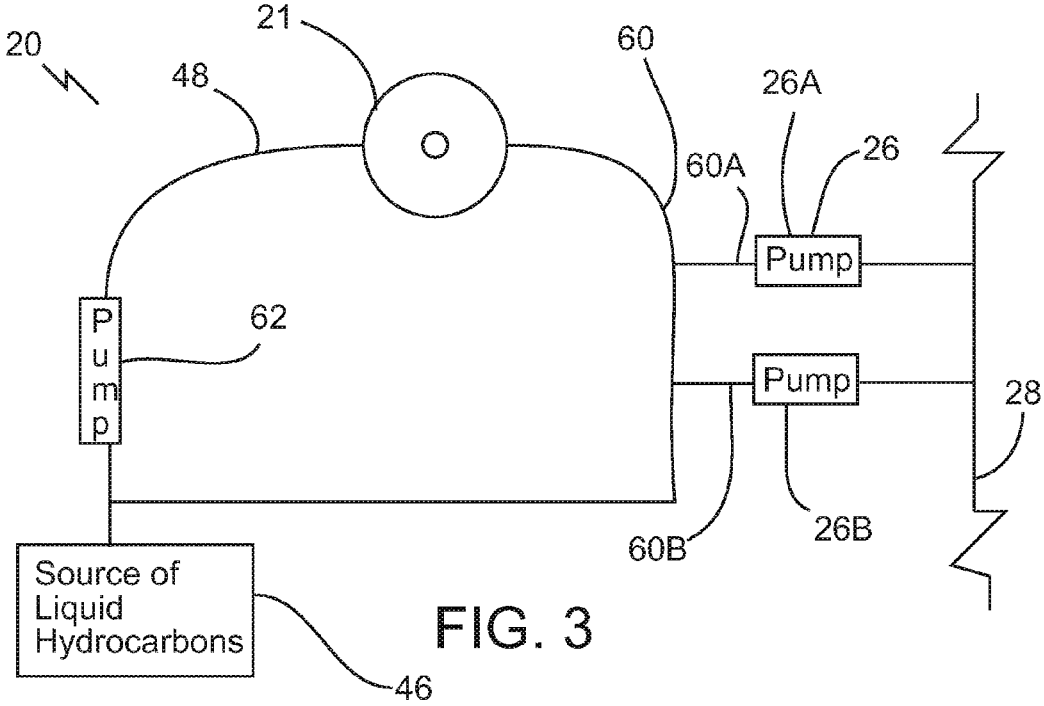
FIG. 3 is a schematic illustrating a further apparatus for fracturing a formation penetrated by a well.

Referring to FIG. 3, an exemplary system is illustrated where proppant supply source 20 is provided. Liquid hydrocarbons are supplied to proppant receiver 21 from liquid hydrocarbon source 46 and inlet 48. The proppant receiver 21 may be a rotary tub, and supplies a mixture of proppant and liquid hydrocarbons to positive displacement pumps 26A, 26B through line 60. At least one pump 26, in this case two, is connected to pump the mixture of proppant and liquid hydrocarbons supplied from the proppant receiver 21 into the stream of frac fluid in line 28. Line 60 feeds lines 60A, 60B into pumps 26A, 26B, respectively. A circulation pump 62 may be provided on inlet 48 to ensure that the frac fluid, for example heavy frac oils are pumped to proppant receiver 21.

Figure 4:
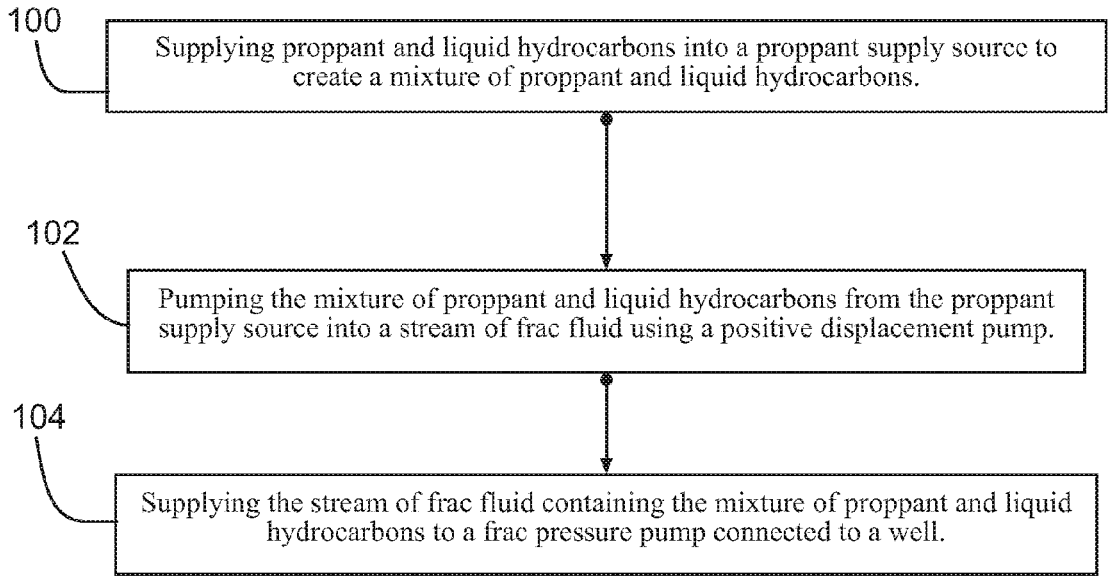
FIG. 4 is a flow diagram illustrating a method of supplying frac fluid to a well.

Referring to FIG. 4, an exemplary method is illustrated. Referring to FIG. 1, in stage 100 (shown in FIG. 4), proppant and liquid hydrocarbons are supplied into a proppant supply source 20 to create a mixture of proppant and liquid hydrocarbons. The liquid hydrocarbons may comprise hydrocarbons having six or more carbons. Auger 24 may be provided to allow a thick, highly solids laden mixture to be channeled from receiver 21 to pump 26 without requiring pressurization. In stage 102 (shown in FIG. 4) the mixture of proppant and liquid hydrocarbons is pumped from the proppant supply source 20 into the stream of frac fluid in line 28 using positive displacement pump 26. In stage 104 (shown in FIG. 4) the stream of frac fluid containing the mixture of proppant and liquid hydrocarbons is supplied to frac pressure pump(s) 16 connected to well 14.

Table 1 below illustrates various slurry rates required to create a stream of frac fluid with specific a wellhead density. The exemplary data is constructed using sand (Regular density 2650 kg/m$^3$) contained as a mixture of proppant and liquid hydrocarbons having 1325 kg of sand and 500 L of liquid hydrocarbons per m$^3$ of mixture in proppant supply source 30. Wellhead flow rate indicates the flow rate of the frac fluid slurry pumped down the well. Wellhead density indicates the density in kg of sand per m$^3$ of frac fluid sent down the well. The third column refers to the amount of sand required to be added to the frac fluid, and the fourth column indicates the amount of sand required to be added to the frac fluid each minute, both in order to achieve the desired wellhead density.

TABLE 1

Exemplary Slurry Rates

| Wellhead flow rate (m$^3$/min) | Wellhead Density (kg sand/m$^3$ of slurry) | Kg of Sand added per m$^3$ of frac fluid | kg of sand/ minute needed | Slurry rate leaving Proppant Tank (m$^3$/min) |
|---|---|---|---|---|
| 0 | 0 | 0 | 0 | 0 |
| 3 | 100 | 96.4 | 289.2 | 0.218264151 |
| 3 | 200 | 186 | 558 | 0.421132075 |
| 3 | 300 | 269.5 | 808.5 | 0.610188679 |
| 3 | 400 | 347.5 | 1042.5 | 0.786792453 |
| 3 | 600 | 420.6 | 1261.8 | 0.952301887 |
| 3 | 800 | 614.5 | 1843.5 | 1.391320755 |
| 3 | 1000 | 726 | 2178 | 1.643773585 |

LPG may include a variety of petroleum and natural gases existing in a liquid state at ambient temperatures and moderate pressures. In some cases, LPG refers to a mixture of such fluids. These mixes are generally more affordable and easier to obtain than any one individual LPG, since they are hard to separate and purify individually. Unlike conventional hydrocarbon based fracturing fluids, common LPGs are tightly fractionated products resulting in a high degree of purity and very predictable performance. Exemplary LPGs used in this document include ethane, propane, butane, pentane, and various mixes thereof. Further examples include HD-5 propane, commercial butane, i-butane, i-pentane, n-pentane, and n-butane. The LPG mixture may be controlled to gain the desired hydraulic fracturing and clean-up performance.

LPGs tend to produce excellent fracturing fluids. LPG is readily available, cost effective and is easily and safely handled on surface as a liquid under moderate pressure. LPG is completely compatible with formations and formation fluids, is highly soluble in formation hydrocarbons and eliminates phase trapping—resulting in increased well production. LPG may be readily and predictably viscosified to generate a fluid capable of efficient fracture creation and excellent proppant transport. After fracturing, LPG may be recovered very rapidly, allowing savings on clean up costs.

Referring to FIG. 1, an apparatus 10 is illustrated for fracturing a formation 12 penetrated by a well 14, the apparatus 10 comprising a frac pressure pump 16, and a frac fluid source 18. Frac pressure pump 16 is connected to the well 14, and frac fluid source 18 is connected to supply a stream of frac fluid to the frac pressure pump 16. Fluid lines, for example lines 28 and 29 connecting the frac pressure pump 16, the well 14, and the frac fluid source 18 are present. The fluid lines have isolation valves, for example isolation valves 70C, 70E, 70G, 70H, and 70I spaced so that the volume of fluid containable between any set of neighboring isolation valves is less than or equal to 500 L, for example less than or equal to 400 L, 200 L, 100 L, 70 L, or 50 L. The isolation valves may be remotely controlled by a controller, and activated in the event of for example a leak, an emergency, after pressure testing, or at any suitable stage during the frac procedure. Referring to FIG. 1, apparatus 10 may include other components, such as proppant supply source 20, additive source 38A-B, gas source 36, source 30, pump 40, pump 56, and any other component required. The isolation valves 70A-K compartmentalize the apparatus 10 to define segments of the system that can contain the maximum amount of fluid. For example, valves 70C, 70D, 70J, 70K, and 70E define a segment 71 of line 28 that can be isolated. The isolation valves may be spaced so that each of the frac pressure pump 16, the well 12, the frac fluid source 18, and any other component of the system if desired, may be independently isolated from one another. Vents 72A-K may be spaced in between each set of neighboring isolation valves, in order to provide an outlet for venting the fluid contained in between the isolation valves should a particular segment of the system be isolated. As illustrated, the vents may be connected to vent any fluid present, for example to a flare 74, isolation vessel (not shown), or sales line (not shown). At least some of the vents may be connected to a manifold (not shown) prior to flaring. In some embodiments, a pop tank (not shown) is provided prior to the flare stack 74.

This system provides added safety to frac apparatus 10, especially when the frac fluid source comprises liquefied petroleum gas, since the entire system can be isolated into small segments should one or more components in the system fail. Thus, if for example a leak is detected, the isolation valves may be activated in order to reduce the total amount of frac fluid leaked to the environment to the volume contained in the segment where the leak occurred. Also, should a leak occur in one or more segment and catch fire, the amount of frac fluid available as fuel to the fire can also be reduced by isolating the one or more segments. After a segment is isolated it may be safely vented, in order to clear away any hazardous fluid contained within the fluid lines.

It should be understood that the figures illustrated exemplary systems, and various valving, tubing, connections, and other devices may be necessary in order to properly operate the system.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An apparatus for fracturing a formation penetrated by a well, the apparatus comprising:
   - a frac pressure pump connected to the well;
   - a frac fluid source connected to supply a stream of frac fluid to the frac pressure pump; and
   - a proppant supply source having a proppant receiver, a positive displacement pump, and at least an inlet into the proppant supply source, the at least an inlet being connected to one or more liquid hydrocarbon sources to supply liquid hydrocarbons to proppant in the proppant supply source, the positive displacement pump being connected to pump proppant into the stream of frac fluid before the frac pressure pump.

2. The apparatus of claim 1 in which the stream of frac fluid comprises liquefied petroleum gas.

3. The apparatus of claim 1 in which the proppant supply source is at atmospheric pressure.

4. The apparatus of claim 1 in which the positive displacement pump is a progressive cavity pump.

5. The apparatus of claim 1 in which the proppant receiver has an auger for supplying at least proppant to the positive displacement pump.

6. The apparatus of claim 1 further comprising a pressure seal between the proppant receiver and the positive displacement pump.

7. The apparatus of claim 6 in which a first inlet of the at least an inlet is connected into the proppant supply source before the pressure seal.

8. The apparatus of claim 7 in which a liquid hydrocarbon source connected to supply liquid petroleum to the first inlet comprises hydrocarbons having six or more carbons.

9. The apparatus of claim 6 in which a second inlet of the at least an inlet is connected into the proppant supply source after the pressure seal.

10. The apparatus of claim 9 in which a liquid hydrocarbon source connected to supply the second inlet comprises liquefied petroleum gas.

11. The apparatus of claim 1 in which the one or more liquid hydrocarbon sources comprise hydrocarbons having between eight and ten carbons.

12. The apparatus of claim 1 in which the one or more liquid hydrocarbon sources comprise hydrocarbons having a vapor pressure of less than 200 mm Hg.

13. A method comprising:
   - supplying proppant and liquid hydrocarbons into a proppant supply source to create a mixture of proppant and liquid hydrocarbons;
   - pumping the mixture of proppant and liquid hydrocarbons from the proppant supply source into a stream of frac fluid using a positive displacement pump; and
   - supplying the stream of frac fluid containing the mixture of proppant and liquid hydrocarbons to a frac pressure pump connected to a well.

14. The method of claim 13 in which the proppant supply source has an auger for supplying at least proppant from a proppant receiver of the proppant supply source to the positive displacement pump.

15. The method of claim 14 in which the stream of frac fluid comprises liquefied petroleum gas.

16. The method of claim 13 in which the proppant supply source is at atmospheric pressure.

17. The method of claim 13 in which the positive displacement pump is a progressive cavity pump.

18. The method of claim 13 in which the liquid hydrocarbons comprise hydrocarbons having between eight and ten carbons.

* * * * *